United States Patent [19]

Lawson

[11] Patent Number: 5,052,952

[45] Date of Patent: Oct. 1, 1991

[54] FUSE EJECTOR, EJECTION SYSTEM AND METHOD FOR ASSEMBLY OF FUSE EJECTION SYSTEMS

[75] Inventor: Robert P. Lawson, Snellville, Ga.

[73] Assignee: Siemens Energy & Automation, Inc., Alpharetta, Ga.

[21] Appl. No.: 584,230

[22] Filed: Sep. 18, 1990

[51] Int. Cl.[5] ..... H01R 13/00

[52] U.S. Cl. ..... 439/160; 439/830

[58] Field of Search ..... 439/152, 159, 160, 830–833

[56] References Cited

U.S. PATENT DOCUMENTS

| | | | |
|---|---|---|---|
| 2,051,425 | 8/1936 | Schlums | 439/160 |
| 4,628,413 | 12/1986 | Speraw | 439/160 |
| 4,671,588 | 6/1987 | Fritsch et al. | 439/160 |

*Primary Examiner*—Joseph H. McGlynn

*Attorney, Agent, or Firm*—Peter A. Luccarelli, Jr.

[57] ABSTRACT

A fuse ejector (10) for ejecting fuses from engagement with fuse clips (46) including a rotatable axle (12) with at least one female end portion (16) that is rotatively engageable with a male boss (52) or a male end portion (14) of another ejector if the ejectors are oriented in tandem, such as in a ganged fuse clip chamber assembly. The ejector (10) has a handle (32) and a cam portion (36) for contact within translation of a fuse upon rotation of the axle (12), so that the fuse is ejectable upon handle actuation. The female end portion (16) may include an angular ring (18) having a cut-out portion (22) for lateral engagement with a male boss (52) or the male end portion (14) of another ejector (10). Methods for assembly of a fuse ejection system.

21 Claims, 3 Drawing Sheets

FUSE EJECTOR, EJECTION SYSTEM AND METHOD FOR ASSEMBLY OF FUSE EJECTION SYSTEMS

BACKGROUND OF THE INVENTION

The present invention relates to fuse ejectors and ejection systems and methods for assembling fuse ejection systems.

The installation or removal of elongated fuses from a fuse clip chamber, such as a fuse block, switch block or other type of fuse holder, involves overcoming bias resistance in order to remove the fuse from electrical contact sets, which are also called fuse clips. Tight clearance around the fuse clip chamber which holds at least one end of the fuse may well prevent an electrician from establishing a good grasp of the fuse barrel by mere finger contact.

Over the years, devices have been created to aid an electrician with fuse removal. Tools of the type which aid fuse removal include clip-on type pliers that are used to grasp the fuse barrel between the contact sets or pliers having C-shaped jaws which grasp the fuse barrel.

Other types of fuse puller tools are constructed as an integral part of the fuse clip chamber enclosure. Such types of fuse pullers include loop-type pullers which circle one end of the fuse with a generally elongated O-shaped ring which rides in a track built within the fuse clip chamber or the contact sets. Another kind of loop-type fuse puller is a strap which passes under the fuse barrel, one end of which is connected to the fuse clip chamber and the other end of which acts as a pull lanyard. Another type of fuse puller integral with a fuse clip chamber is an spring-loaded ejector assembly which holds the fuse and ejects as a cartridge with the fuse. Another type of fuse puller is an ejector lever which is pivotally-attached to the fuse clip chamber or the fuse clip and includes a rigid loop constructed on the lever in which rides the fuse barrel. Rotation of a handle on the lever creates a torque moment, which disengages the fuse from fuse clips. Such a lever-type fuse puller is shown in U.S. Pat. No. 3,518,599.

The prior known fuse pullers have disadvantages. Clip-on and plier-type fuse pullers are not an integral part of the fuse assembly and may be misplaced, or the electrician may not have the tool handy when needed to replace or install a fuse. Also, while clip-on and plier-type fuse pullers may be satisfactory for relatively low amperage fuses, they do not provide the additional leverage to disengage industrial-size fuses. Loop-type and strap-type fuse pullers also do not provide additional leverage for removing fuses.

The application of ejector-type fuse cartridges is limited as fuse size and weight increases, due to the amount of force which must be generated by the spring-loaded ejector. Spring-loaded ejector assemblies and cartridges are relatively complex and increase manufacturing costs.

While lever-type fuse ejectors, such as shown in U.S. Pat. No. 3,518,599, provide additional leverage for ejection of fuses, the lever design shown in that patent, due to the nature of its construction, does not maximize fuse insertion and removal efficiency and is too complex for modern fuse clip chamber manufacturing techniques. The fuse ejector lever shown in U.S. Pat. No. 3,518,599 is constructed of multi-piece stamped metal components and has a stirrup which completely encircles the fuse.

Where such an assembly lever is used in a narrowly confined location, the electrician has difficulty inserting or removing the fuse from the stirrup, because it is analogous to threading a needle. In addition, the lever assembly shown in the '599 patent does not facilitate mass production of ganged assemblies of fuse clip chambers which must be manufactured at low cost. Contemporary manufacturing techniques stress reduction of subassembly component quantities and maximization of the use of components which are capable of being manufactured of plastic.

It is an object of the present invention to create a fuse ejector which provides mechanical leverage for ejecting fuses from their biased fuse clip assemblies.

It is another object of the present invention to create a fuse ejector which allows easy insertion and removal of a fuse from the ejector, even in narrowly confined locations.

It is also an object of the present invention to create a fuse ejection system which allows efficient production assembly of fuse ejectors within fuse clip chambers, including ganged fuse clip chambers, which have a plurality of fuse clip chambers and ejectors in tandem, side-by-side relation.

SUMMARY OF THE INVENTION

The above-defined objects have been accomplished by the fuse ejector of the present invention for ejecting fuses from engagement with fuse clips, comprising a rotatable axle having a pair of end portions, at least one female end portion on one end thereof that is rotatively engageable with a male boss, the female end portion having means for lateral engagement with the male boss, and the axle having a rotational axis about the end portions thereof. The ejector has a handle attached to the axle for causing axle rotation upon actuation of the handle, and a cam portion attached to at least one of the axle and handle for contact with and translation of a fuse upon rotation of the axle. The ejector axle, handle and cam portion are oriented with respect to each other so that the fuse is ejectable upon handle actuation without obstruction by the ejector.

The present invention also includes a ganged fuse ejection system for ejecting fuses from engagement with fuse clips, comprising a plurality of ganged fuse clip chambers which are attached to each other in side-by-side, tandem orientation, each having at least one sidewall. The system has a plurality of fuse ejectors, each inserted into a contact chamber. Each ejector has a rotatable axle having a pair of and portions, that are rotatively engaged with the sidewalls and a rotational axis through the end portions. The ejector also has a handle attached to the axle for causing axle rotation upon actuation of the handle. The ejector also has a cam portion attached to at least one of the axle and handle for contact with and translation of a fuse upon rotation of the axle, so that the fuse is ejected upon handle actuation. In this ejection system, at least one of the axle end portions and sidewalls has a female end portion that is rotatively engageable by means for lateral engagement with a male boss on the other of the axle end portion and sidewall. The ejector may have two female end portions which engage a pair of male bosses on the sidewalls. Alternatively the ejector axle may have a pair of male end portions which form male bosses that engage a pair of female end portions on the contact chamber sidewalls. The ejection system may also be constructed so that the ejector has one male boss and one female end portion which engage with a corresponding respective female end portion and male boss on the contact chamber sidewalls.

Another embodiment of ganged fuse ejection systems for ejecting fuses from engagement with fuse clips comprises a plurality of ganged fuse clip chambers which are attached to each other in side-by-side, tandem orientation, each having a sidewall having an aperture therein. The ejection system also has a plurality of fuse ejectors, each inserted into a contact chamber, each ejector having a rotatable axle having a male end portion on one end thereof and a female end portion on another end thereof that is rotatively engageable by means for lateral engagement with one of a male end portion of another ejector that has been inserted through an aperture from in adjoining chamber and a male boss. The ejector male portions are rotatively engageable with the apertures and with the female end portions of ejectors which are engaged therewith. The axle has a rotational axis through the end portions thereof. The ejectors each have a handle attached to the axle for causing axle rotation upon actuation of the handle, and a cam portion attached to at least one of the axle and handle for contact with and translation of a fuse upon rotation of the axle, so that the fuse is ejected upon handle actuation.

The present invention is also directed to methods for manufacturing a fuse ejection systems. One method of the present invention for assembling a fuse ejection system comprises the steps of obtaining a fuse clip chamber having a sidewall with an aperture therein and allocating a fuse ejector having a rotatable axle having a male end portion on one end thereof and a female end portion on another end thereof the female end portion having means for lateral snapping engagement with a male boss, the axle having a rotational axis through the end portions thereof, a handle attached to the axle for casing axle rotation upon actuation of the handle, and a cam portion attached to at least one of the axle and handle for contact with and translation of a fuse upon rotation of the axle. The next step of this method is inserting the male end portion of the first ejector through the fuse clip chamber aperture. After the inserting step, the next step is coupling the first ejector female end portion with a first male boss within the first fuse clip chamber by aligning laterally the means for lateral snapping engagement with the first male boss and radially translating such means relative to the rotational axis into engagement with the boss.

Another method of the present invention for manufacturing a fuse ejection system comprises the steps of attaching in side-by-side tandem orientation a plurality of fuse clip chambers each allocating a fuse ejector for each fuse clip chamber, each having a sidewall having an aperture therein. The next step is ejector having a rotatable axle having a male end portion on one end thereof and a female end portion on another end thereof, the female end portion having means for lateral snapping engagement with a male boss, the axle having a rotational axis through the end portions thereof, a handle attached to the axle for causing axle rotation upon actuation of the handle, and a cam portion attached to at least one of the axle and handle for contact with and translation of a fuse upon rotation of the axle. The next step of the method is inserting the male end portion of a first ejector through the aperture of a first one of the fuse clip chambers into an adjoining second contact chamber.

After the inserting step, the next step is coupling the first ejector female end portion with a first male boss of the first fuse clip chamber by aligning laterally the means for lateral snapping engagement with the first male boss and radially translating such means relative to the rotational axis into engagement with the boss. The next step is inserting the male end portion of a second ejector into the second fuse clip chamber aperture. The next step involves coupling the second ejector female end portion with the first ejector male portion by aligning laterally the second ejector means for lateral snapping engagement with the first ejector male end portion that is protruding into the second chamber and radially translating such means relative to the rotational axis into engagement with the first ejector male portion.

DESCRIPTION OF THE PREFERRED EMBODIMENTS

Figure 1:
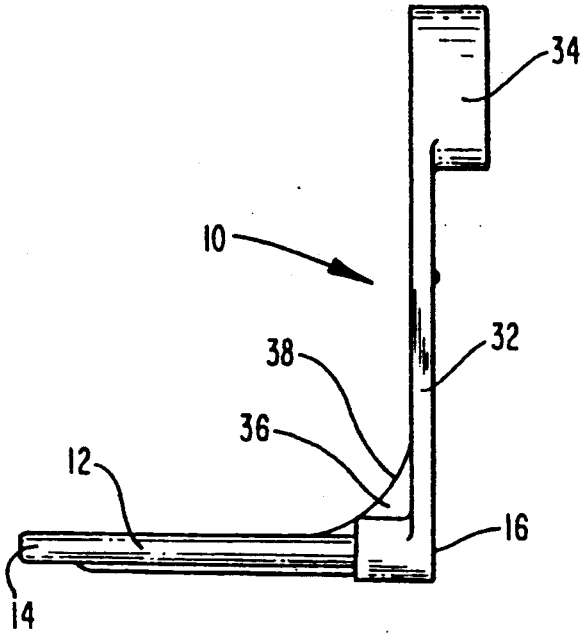
FIG. 1 is a front-elevational view of the fuse ejector of the present invention.
Figure 2:
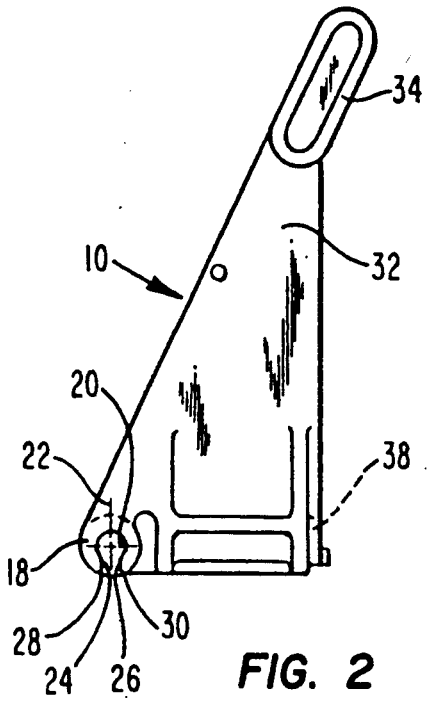
FIG. 2 is a side-elevational view of the fuse ejector of the present invention.
Figure 2A:
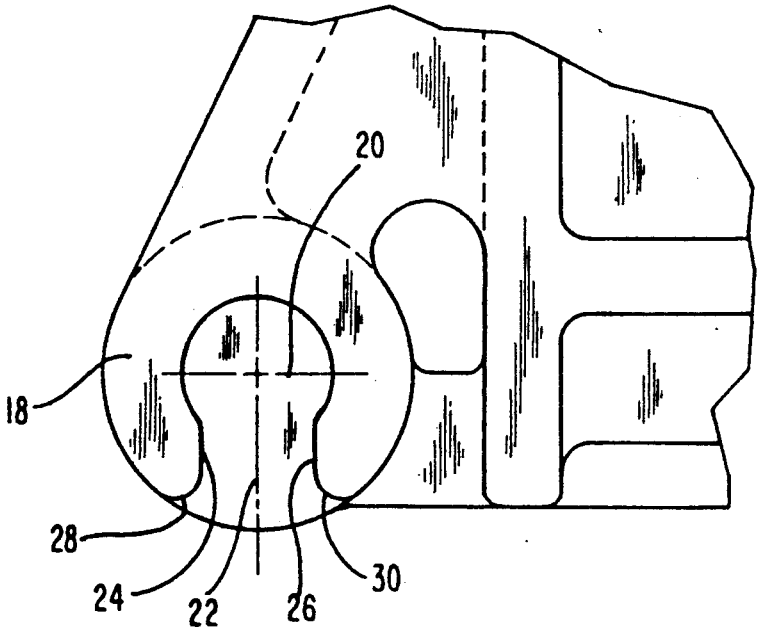
FIG. 2A is a detailed side-elevational view of the female end portion of the ejector of the present invention.
Figure 3:
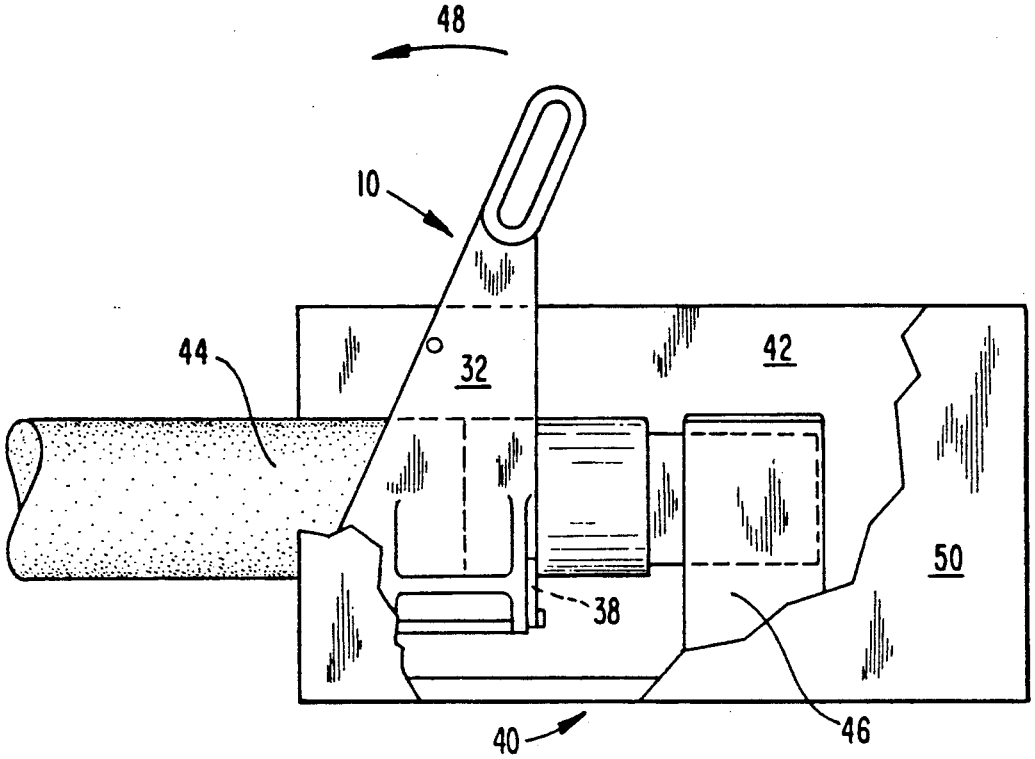
FIG. 3 is a side-elevational view of the fuse ejector system of the present invention with the fuse clip chamber partially broken away and the fuse fully engaged with the fuse contacts.
Figure 4:
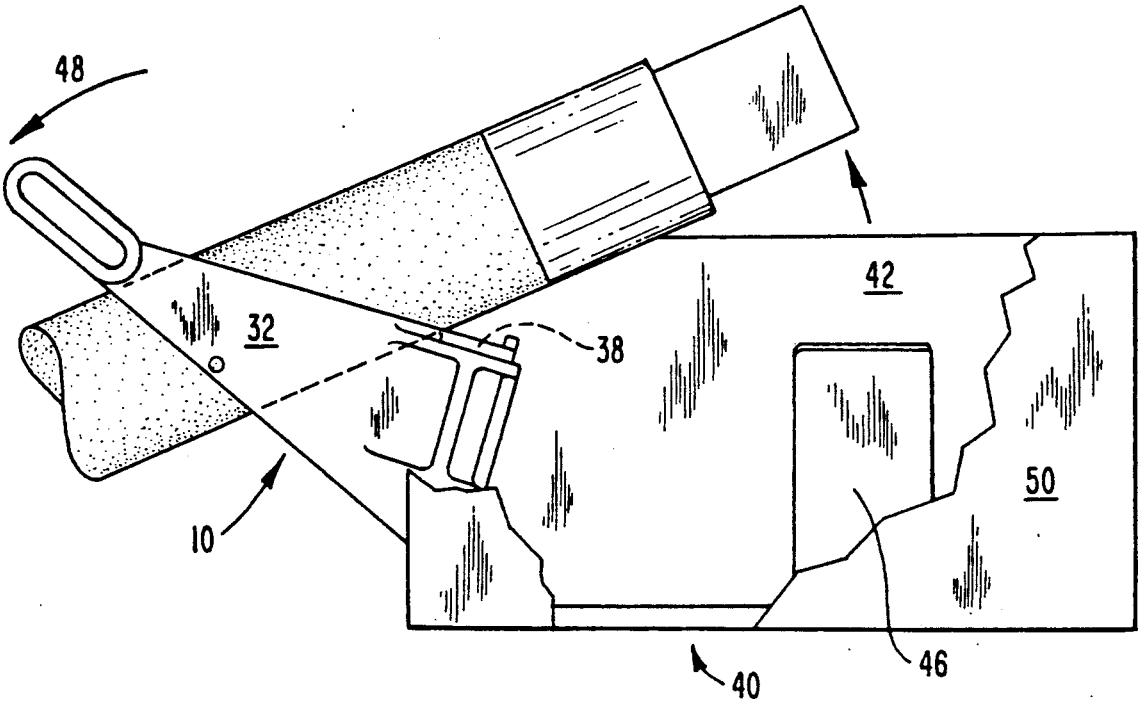
FIG. 4 is similar to the view of FIG. 3, with the fuse shown ejected.
Figure 5:
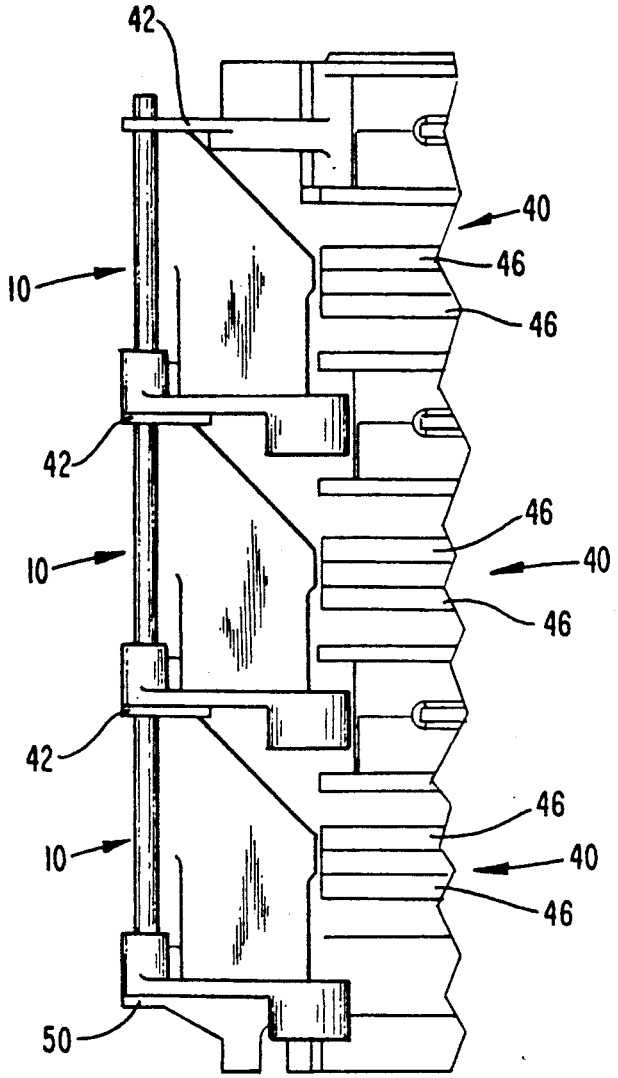
FIG. 5 is a top plan schematic view of the fuse ejection system of the present invention, shown with three ganged fuse clip chambers and fuse ejectors.
Figure 6:
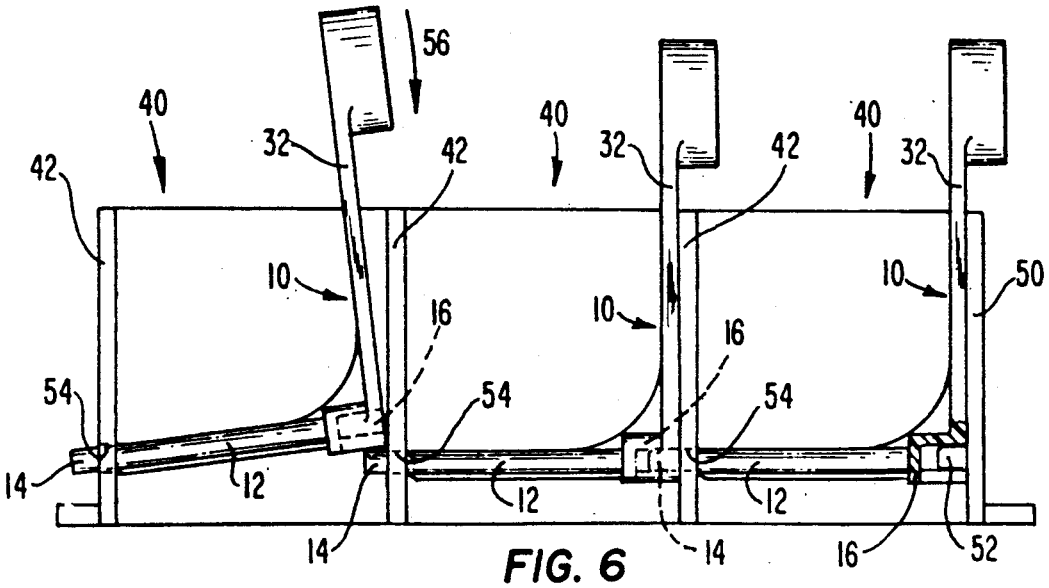
FIG. 6 is a front-elevational schematic view of three ganged fuse clip chambers showing snap-in lateral engagement of the fuse ejectors to form a ganged row of ejectors.

The fuse ejector of the present invention is shown generally in FIGS. 1, 2 and 2A. Operation of the ejector as installed in a fuse clip chamber for ejection of fuses is shown in FIGS. 3 and 4. Lastly, application of the fuse ejector of the present invention in a fuse ejection system having a plurality of ganged fuse clip chambers in tandem, side-by-side relationship, and the method for assembling such a fuse ejection system is shown in FIGS. 5 and 6.

Referring generally to FIGS. 1, 2 and 2A, the fuse ejector 10 of the present invention has a rotatable axle 12. The axle 12 has a male end portion 14 on one end that is rotatively engageable with a female boss, such as an aperture, and a female end portion 16 on the other end of the axle 12 that is rotatively engageable with a male boss, including the male end portion of another ejector.

As is shown in greater detail in FIG. 2A, the female end portion has an annular ring 18 which defines an annular bore 20 having a cut-out portion 22, which in turn is defined by cut-out walls 24 and 26. The cut-out walls 24 and 26 are preferably generally parallel, though the cut-out walls may converge toward the annular bore 20. The female end portion 16 has radiused tapered edges 28 and 30 which blend the cut-out walls 24 and 26 with the outer periphery of the annular ring 18. The cut-out portion 22 width between the cut-out walls 24 and 26 is preferably less than the annular bore 20 diameter and the diameter of the intended male boss, so as to prevent inadvertent travel of the male boss radially outwardly with respect to the annular bore 20 during operation of the fuse ejector 10. The cut-out portion 22 width is also selected to be sufficiently wide with respect to the male boss diameter so as to allow lateral engagement of the female end portion 16 with the male boss by directing the boss radially inwardly through the cut-out 22, which biases the cut-out walls 24 and 26 outwardly away from the cut-out portion 22.

Thus, a male boss may be laterally engaged with the female end portion 16 by translating the female end portion cut-out 22 radially relative to the axle rotational axis and retained within the annular bore 20 by a snap-in fit.

The fuse ejector 10 has a handle 32 attached to axle 12 for causing axle rotation upon actuation of the handle. The handle 32 may be provided with a handle grip 34 for finger engagement, in order to assist handle actuation.

As shown in FIG. 1, the ejector 10 has a cam portion 36 that is attached to the axle 12 and the handle 32. Alternatively, the cam portion 36 may be attached to either of the axle 12 or handle 32, though the ejector 10 has greater structural rigidity if the cam portion 36 is attached to both the handle and axle.

As shown in FIG. 1, the cam portion 36 preferably has a saddle-shaped concave surface 38 which may be used for contact with the outer circumference of the fuse barrel. Referring to FIGS. 5 and 6, the ejector 10 is pivotally attached to the sidewalls 42, 50 of a fuse clip chamber, which establishes a rotational axis about the male and female end portions 14 and 16.

FIG. 3 shows a schematic representation of a fuse clip chamber 40 having sidewalls 42 and 50. A cylindrical fuse 44 has one of its conductive ends engaged within spring loaded fuse clip 46. Rotation of fuse handle 32 in a counterclockwise direction as shown by arrow 48 rotates the saddle-shaped co surface 38 of the cam portion in contact with the fuse 44 outer surface. The actual contact position of the ejector cam portion 36 with the fuse 44 outer surface depends upon the fuse diameter. Comparison of FIGS. 3 and 4 shows that continued rotation of the handle 48 in a counterclockwise direction pivots the contact of fuse 44 out of its engagement with the spring loaded fuse clip 46. The electrician is now free to grasp the exposed barrel of fuse 44 and disengage it from the fuse clips at the other end of the fuse. The open-top construction of the ejector 10 allows easy access and removal of the fuse 44 once the fuse is disengaged from the fuse clip 46. The ejector 10 of the present invention does not surround the fuse; thus the electrician does not have to perform a needle threading-like operation to insert or remove the fuse 44 from the ejector 10 assembly as has been required with previously known lever-type ejectors.

The fuse ejector 10 of the present invention may be advantageously incorporated into a ganged fuse clip chamber array and its structural features greatly simplify construction and assembly of such ganged fuse ejector systems.

In FIGS. 5 and 6 there is shown by way of an example a ganged array of three side-by-side fuse clips chambers 40. The fuse clips chambers 40 include an attached left wall 42. The chambers 40 are placed in side-by-side relationship, so that they share a common sidewall 42 with their left-most neighbor. The right-most chamber has a fuse clip chamber sidecap 50, which has a male boss 52. The boss 52 may be molded in or otherwise attached to the fuse clip chamber sidecap 50. An alternate construction of the male boss can be a plug which is friction fitted, ultrasonic welded, glued or otherwise attached to an aperture in the sidecap 50 wall. As shown in FIG. 6, the male boss 52 engages within the female end portion 16 of an ejector 10. The sidewalls 42 have apertures 54 therethrough, which receive the male end portions 14 of the ejectors 10.

As is shown in FIG. 6, the male end portions 14 of the ejectors 10 protrude through the apertures 54 into the adjoining leftwardly oriented fuse clip chamber 40, for engagement with the female end portion 16 of the ejector 10 in that respective chamber. Referring to the left-most ejector 10 in the left-most fuse clip chamber in FIG. 6, the ejector 100 is installed in the ganged arrayed by laterally engaging the female end portion 16 of the ejector 10 with the male end portion 14 of the ejector 10 which protrudes through the aperture 54 of the commonly shared sidewall 42 between the left-most and middle fuse clip chambers 40. Engagement is accomplished by lining the cut-out portion 22 of the female end portion 16 laterally with the male end portion 14, which alignment is assisted by the radiused tapered portions 28 and 30 shown in FIG. 2A. Once lateral alignment is achieved, the ejector 10 is snapped over the protruding male portion 14 by rocking the ejector handle 32 clockwise (i.e., generally radially with respect to the ejector 10 rotational axis), as shown by the directional arrow 56 until the male portion 14 is snapped within the annular ring bore 20. Thus the middle chamber ejector male end portion 14 functions as a male boss for the leftmost chamber.

Alternatively, the fuse ejection system can be assembled from left to right by inserting in an axial direction the male end portion 14 through an aperture 54 and into an awaiting female end portion 16, thus only requiring that the rightmost ejection female end portion 16 be snapped on the sidecap male boss 52.

While FIGS. 5 and 6 show a fuse ejections system with three ganged fuse clip chambers 40, it should be understood that any number of desired fuse clip chambers 40 can be assembled in tandem fashion. For example, a two-pole load distribution apparatus would have a pair of tandem-mounted fuse clip chambers 40 and a four-pole system would desirably have four tandem-mounted fuse clip chambers 40.

Whereas in FIGS. 5 and 6 the fuse clip chambers 40 share a common left-most sidewall 42, the right-most chamber can utilize a separately attached fuse clip chamber sidecap 50, thereby minimizing the number of types of fuse clip chamber fabrications to one (i.e., only a single leftwall 42 connectable to other fuse clip chambers 40 but no right sidewall). Alternatively, the right-most fuse clip chamber can be constructed with a pair of integral sidewalls, if the manufacturer does not object to creating two separate fabrication designs. The same ejector 10 construction can be used within any fuse clip chamber of the ganged array.

The, ejectors and fuse clip chambers can be constructed of any material deemed suitable by those skilled in the art, but the preferred material is molded insulating plastic, such as DELRIN Grade 570 manufactured by the DuPont Corporation. Molded or extruded ejector and fuse clip chamber fabrications minimize fabrication costs and their modular construction allows rapid assembly into ganged arrays and ganged ejection systems with minimal assembly costs.

While a preferred embodiment of the fuse ejection system has been described above and shown in FIGS. 1–6, the system can also be constructed in an embodiment wherein the fuse ejector has a pair of female end portions as shown in FIG. 2A which engage a pair of male bosses on each of the fuse clip chamber sidewalls, such as the male boss 52 shown in FIG. 6. It is also possible to construct the fuse clip chamber sidewalls with a pair of the female end portions such as shown in FIG. 2A. Alternatively, the fuse ejection system of the present invention may also be constructed with one male boss on each of the ejector and sidewall and a corresponding mating female portion such as shown in FIG. 2A on the other axle ejector end portion and fuse clip chamber sidewall.

The foregoing description of the preferred embodiments is intended to illustrate without limitation the present invention. It is understood, of course, that changes and variations can be made therein without departing from the scope of the invention which is defined in the following claims.

What is claimed is:

1. A fuse ejector for ejecting fuses from engagement with fuse clips, comprising:

a rotatable axle having a pair of end portions, at least one female end portion on one end thereof that is rotatively engageable with a male boss, the female end portion having means for lateral engagement with the male boss, and the axle having a rotational axis about the end portions thereof;

a handle attached to the axle for causing axle rotation upon actuation of the handle; and a cam portion attached to at least one of the axle and handle for contact with and translation of a fuse upon rotation of the axle;

the axle, handle and cam portion oriented with respect to each other so that the fuse is ejectable upon handle actuation without obstruction by the ejector.

2. The fuse ejector of claim 1, wherein the ejector has unitary construction.

3. The fuse ejector of claim 1, wherein the ejector is constructed of plastic.

4. The fuse ejector of claim 1, wherein the axle has a male end portion on the other end thereof that is rotatively engageable with a female boss on the sidewall.

5. The fuse ejector of claim 1, wherein the cam portion has a concave saddle for abutment against a fuse outer surface.

6. The fuse ejector of claim 1, wherein the means for lateral engagement is an annular ring which has a bore defined within the ring, the ring having a radially-oriented cut-out portion for insertion of a male boss into the ring bore by radial movement of the axle relative to its rotational axis.

7. The fuse ejector of claim 6, the annular cutout portion is defined by a pair of walls which are generally parallel to a radius of the annular ring and which are spaced apart by a gap which is less than the ring bore diameter.

8. A ganged fuse ejection system for ejecting fuses from engagement with fuse clips, comprising:

a plurality of ganged fuse clip chambers which are attached to each other in side-by-side, tandem orientation, each having at least one sidewall; and a plurality of fuse ejectors, each inserted into a fuse clip chamber; each ejector having a rotatable axle having a pair of end portions that are rotatively engaged with the sidewalls; a rotational axis through the end portions thereof; a handle attached to the axle for causing axle rotation upon actuation of the handle; and a cam portion attached to at least one of the axle and handle for contact with and translation of a fuse upon rotation of the axle, so that the fuse is ejected upon handle actuation;

at least one of the axle end portions and sidewalls having a female end portion that is rotatively engageable by means for lateral engagement with a male boss on the other of the axle end portion and sidewall.

9. A ganged fuse ejection system for ejecting fuses from engagement with fuse clips, comprising:

a plurality of ganged fuse clip chambers which are attached to each other in side-by-side, tandem orientation, each having a sidewall having an aperture therein; and a plurality of fuse ejectors, each inserted into a fuse clip chamber, each ejector having a rotatable axle having a male end portion on one end thereof that is insertable through the sidewall aperture, and a female end portion on another end thereof that is rotatively engageable by means for lateral engagement with one of a male end portion of another ejector that has been inserted through an aperture from an adjoining chamber and a male boss, the ejector male portions rotatively engageable with the apertures and with the female end portions of ejectors which are engaged therewith, the axle having a rotational axis through the end portions thereof, a handle attached to the axle for causing axle rotation upon actuation of the handle, and a cam portion attached to at least one of the axle and handle for contact with and translation of a fuse upon rotation of the axle, so that the fuse is ejected upon handle actuation.

10. The fuse ejector of claim 9, wherein the ejector has unitary construction.

11. The fuse ejector of claim 9, wherein the cam portion has a concave saddle for abutment against a fuse outer surface.

12. The fuse ejector of claim 9, wherein the ejector is constructed of plastic.

13. The fuse ejector of claim 12, wherein the ejector is constructed of molded plastic.

14. The fuse ejector of claim 9, wherein the means for lateral engagement is an annular ring which has a bore defined within the ring that is concentric with the axle rotational axis, the ring having a radially-oriented cut-out portion for insertion of a male boss into the ring bore by radial movement of the axle relative to its rotational axis.

15. The fuse ejector of claim 14, wherein the annular cutout portion is defined by a pair of walls which are generally parallel to a radius of the annular ring and which are spaced apart by a gap which is less than the ring bore diameter.

16. A method for assembling a fuse ejection system comprising the steps of:

acquiring a fuse clip chamber having a sidewall with an aperture therein;

obtaining a fuse ejector having a rotatable axle having a male end portion on one end thereof and a female end portion on another end thereof, the female end portion having means for lateral snapping engagement with a male boss, the axle having a rotational axis through the end portions thereof, a handle attached to the axle for causing axle rotation upon actuation of the handle, and a cam portion attached to at least one of the axle and handle for contact with and translation of a fuse upon rotation of the axle;

inserting the male end portion of the ejector through the fuse clip aperture; and coupling the first ejector female end portion with a first male boss within the first fuse clip chamber by aligning laterally the means for lateral snapping engagement with the first male boss and radially translating such means relative to the rotational axis into engagement with the boss.

17. A fuse ejection system manufactured according to the method of claim 16.

18. A method for assembling a fuse ejection system comprising the steps of:

attaching in side-by-side tandem orientation a plurality of fuse clip chambers each having a sidewall having an aperture therein;

allocating a fuse ejector for each fuse clip chamber, each ejector having a rotatable axle having a male end portion on one end thereof and a female end portion on another end thereof, the female end portion having means for lateral snapping engagement with a male boss, the axle having a rotational axis through the end portions thereof, a handle attached to the axle for causing axle rotation upon actuation of the handle, and a cam portion attached to at least one of the axle and handle for contact with and translation of a fuse upon rotation of the axle;

inserting the male end portion of a first ejector through the aperture of a first one of the fuse clip chambers into an adjoining second fuse clip chamber;

coupling the first ejector female end portion with a first male boss of the first fuse clip chamber by aligning laterally the means for lateral snapping engagement with the first male boss and radially translating such means relative to the rotational axis into engagement with the boss;

inserting the male end portion of a second ejector into the second fuse clip chamber aperture; and coupling the second ejector female end portion with the first ejector male portion by aligning laterally the second ejector means for lateral snapping engagement with the first ejector male end portion that is protruding into the second chamber and radially translating such means relative to the axle rotational axis into engagement with the first ejector male portion.

19. A fuse ejection system manufactured according to the method of claim 18.

20. The method of claim 18, further comprising repeating the inserting and coupling steps with a third ejector that is inserted into a third fuse clip chamber which adjoins the second fuse clip chamber.

21. The method of claim comprising repeating successively the inserting and coupling steps with any selected number of ejectors and adjoining fuse clip chambers.

* * * * *